US011284178B1

(12) United States Patent
Kairy, Jr.

(10) Patent No.: US 11,284,178 B1
(45) Date of Patent: Mar. 22, 2022

(54) MICROPHONE CORD HOLDING DEVICE

(71) Applicant: William Kairy, Jr., Napa, CA (US)

(72) Inventor: William Kairy, Jr., Napa, CA (US)

( * ) Notice: Subject to any disclaimer, the term of this patent is extended or adjusted under 35 U.S.C. 154(b) by 0 days.

(21) Appl. No.: 17/149,729

(22) Filed: Jan. 15, 2021

(51) Int. Cl.
*H04R 1/08* (2006.01)
*G10G 5/00* (2006.01)

(52) U.S. Cl.
CPC ..... *H04R 1/083* (2013.01); *G10G 5/00* (2013.01)

(58) Field of Classification Search
CPC ..... H04R 1/028; H04R 1/08; H04R 1/083; G10G 5/00
See application file for complete search history.

(56) References Cited

U.S. PATENT DOCUMENTS 3,219,765 A * 11/1965 Pless ..... H04R 1/08 381/361
6,323,405 B1 * 11/2001 Yu ..... G10G 5/00 84/327
6,802,484 B1 * 10/2004 Kiley ..... A47G 23/0225 248/121
7,176,366 B1 * 2/2007 Bruce ..... A47B 81/00 84/327
2010/0067729 A1 * 3/2010 Upham ..... G10H 1/32 381/363

* cited by examiner

*Primary Examiner* — Thang V Tran
(74) *Attorney, Agent, or Firm* — Savantek Patent Services; Ivan E. Rozek

(57) ABSTRACT

A microphone cord holding device attachable onto a standard microphone stand by a spring clamp comprising an upper and a lower U-shape end are attached to each other by a rigid elongate connector. One arm of the upper U-shape end is attached to the spring clamp. A hook and loop strap is fastened to the midpoint of the rigid elongate connector so that a microphone cord can be wrapped around the upper and lower U-shape ends and held in place by the hook and loop strap. The microphone cord holding device can be used without being attached to a microphone pole to help store the cord when the microphone is not attached to a microphone stand.

2 Claims, 4 Drawing Sheets

MICROPHONE CORD HOLDING DEVICE

CROSS REFERENCE TO RELATED APPLICATIONS

Not Applicable.

STATEMENT REGARDING FEDERALLY SPONSORED RESEARCH OR DEVELOPMENT

Not Applicable.

DESCRIPTION OF ATTACHED APPENDIX

Not Applicable.

BACKGROUND OF THE INVENTION

This invention relates generally to the microphone accessories and more specifically to a microphone cord holding device that attaches to a microphone stand. When a performing artist is using a microphone, he or she often needs to unplug the cord, also known as a cable, to a microphone when the microphone is not in use. These cords can be quite long and can present a tripping hazard if left unattended and not stored. It would therefore be advantageous to have a microphone cord holding device in close proximity to the microphone that can store the cord in a neat way as to reduce the possibility of a person getting tangled in the unstored cord. Neat cord storage also improves the neatness of the recording studio. An additional advantage is that the microphone is protected from potential damage that might occur when a person trips over a microphone cord and causes strain on the connection between the cord and the microphone.

BRIEF SUMMARY OF THE INVENTION

The primary object of the invention is to provide a microphone cord holding device that can be easily attached to a microphone stand.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a microphone cord holding device that can be easily attached to a microphone stand that includes opposing U-shape ends connected by a rigid central elongate connector, one U-shape end attached to a spring biased clamp designed to be removably attached to a microphone stand, the opposing U-shape ends capable of securing a microphone cord by winding the cord around the opposing U-shape ends and securing it with an attached hook and loop fastening strap.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
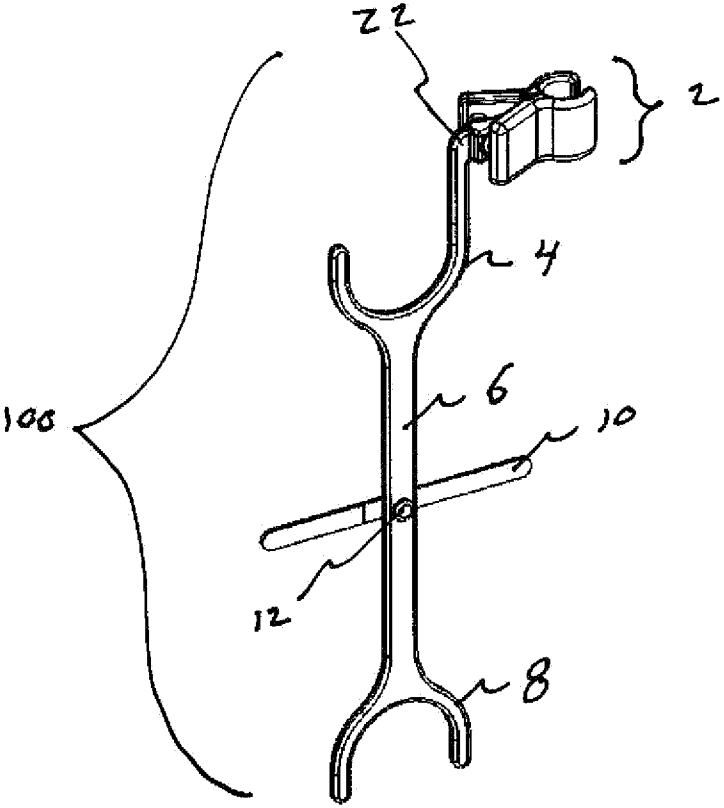
FIG. 1 is a perspective view of the embodiment

Referring now to FIG. 1 we see a perspective view of the microphone cord holding device 100. Opposing U shape ends 4, 8 are integrally attached via elongate connector 6, joining the arc of the upper U-shape end to the arc of the lower U-shape end, wherein the elongate connector is joined to the upper U-shape end in proximity of the arc apex and to the lower U-shape end arc in proximity of the arc apex. The upper U-shape portion 4 terminates on one side in a juncture 22 that connects the upper U-shape portion 4 with a spring biased clamp assembly 2. The clamp assembly allows the microphone cord holding device embodiment to be removably attached to a microphone stand 16 as shown in FIGS. 2, 3 and 4.

Figure 2:
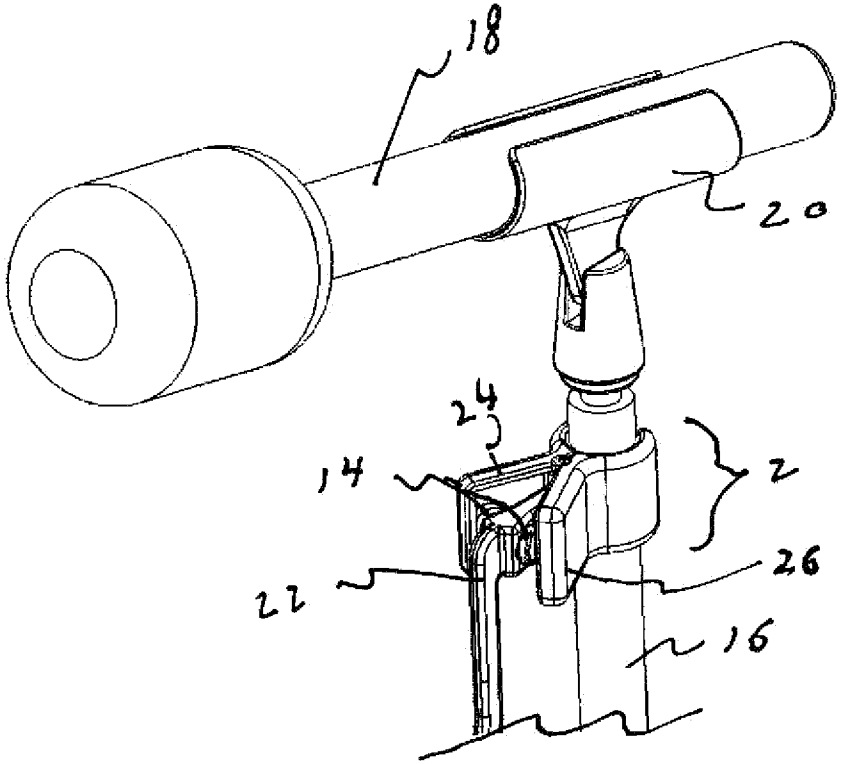
FIG. 2 is a partial perspective view of the spring biased portion of the microphone cord holder device attached to a microphone stand.

FIG. 2 is a partial perspective view of a microphone stand 16 and microphone holder 20 with the spring biased 14 clamp 2 attached to microphone stand 16.

Figure 3:
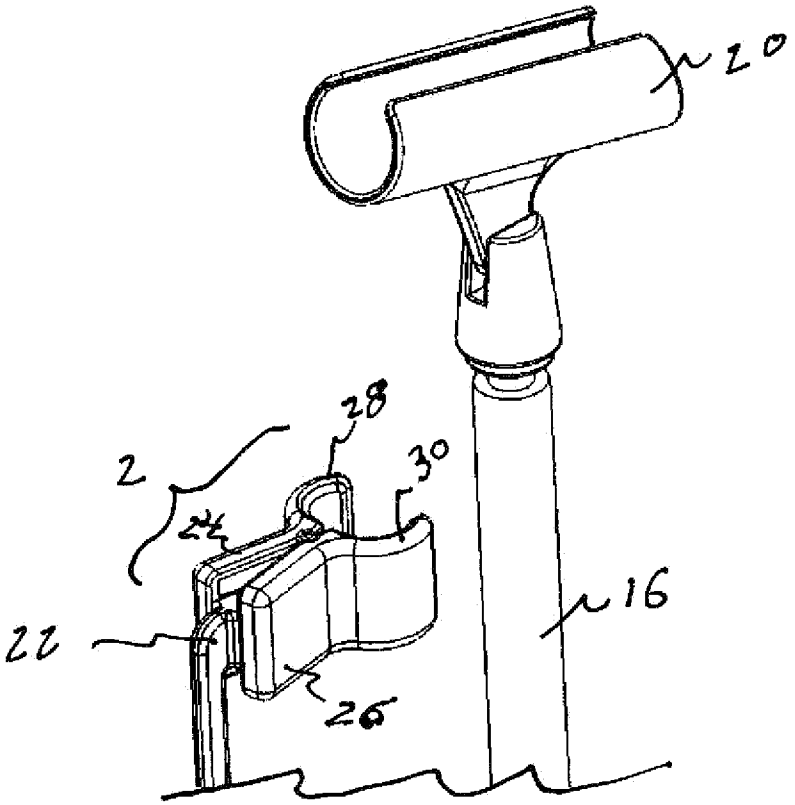
FIG. 3 is a perspective view the spring biased portion removed from the microphone stand.

FIG. 3 shows the clamp 2 with compression tabs 25, 26 pressed inward to allow the gripping jaws 28, 30 to expand so that they can be placed around the outside diameter of microphone pole 16.

Figure 4:
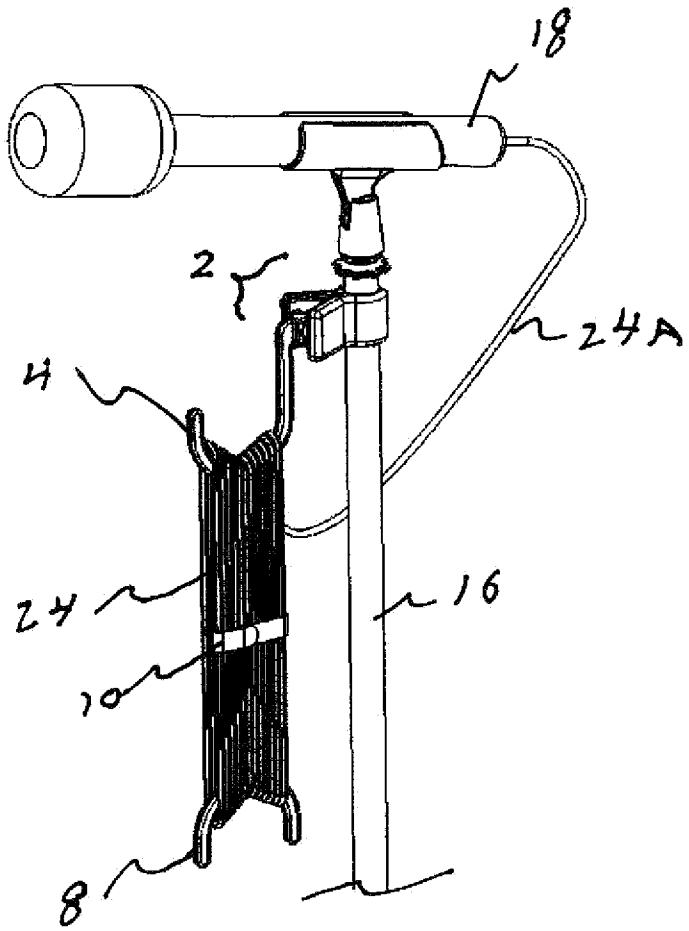
FIG. 4 is a perspective view of the embodiment with the microphone core wrapped around the opposing U-shape ends.

FIG. 4 is a perspective view of the i microphone cord holding device embodiment 100 with a microphone cord 24, also known as a cable, wrapped around opposing U-shape ends 4, 8 and held in place by hook and loop fastening strap 10. One end of the cord 24A extends to the rear portion of the microphone 18. This type of storage for the microphone cord 24 keeps the cord 24 from becoming tangled and potentially becoming a tripping hazard. The entire microphone cord holding device 100 can also be removed from the microphone stand 16 and kept with the microphone 18 when storing the microphone in a location other than on top of a microphone stand.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A microphone cord holding device comprising:

a rigid elongate member comprising an upper U-shape end, a lower U-shape end, wherein the upper U-shape end and the lower U-shape end each comprise two legs connected by an arc, wherein furthermore the rigid elongate member comprises an elongate connector, the elongate connector joining the arc of the upper U-shape end to the arc of the lower U-shape end, wherein the elongate connector is joined to the upper U-shape end in proximity of the arc apex and to the lower U-shape end arc in proximity of the arc apex;

a hook and loop fastening strap, wherein the hook and loop fastening strap being centrally connected to the elongate connector in proximity of longitudinal center of the elongate connector;

a spring biased clamp;

one leg of the upper U-shape end being connected to the spring biased clamp; and the upper U-shape end and the lower U-shape end removably retaining a microphone cable wound around the upper U-shape end and the lower U-shape end and further held in place by the hook and loop fastening strap, wherein the microphone cord holding device being removably attached to a microphone stand by the spring biased clamp.

2. A microphone cord holding device as claimed in claim 1 wherein the spring biased clamp can be disengaged from the microphone stand to allow a microphone to be stored along with a cord that is neatly wrapped on the microphone cord holding device.

* * * * *